US009272439B2

(12) United States Patent
Dammertz

(10) Patent No.: US 9,272,439 B2
(45) Date of Patent: Mar. 1, 2016

(54) RIP FENCE FOR A TABLE SAW HAVING INDEPENDENT ALIGNMENT AND LOCKING

(71) Applicants: Robert Bosch Tool Corporation, Broadview, IL (US); Robert Bosch GmbH, Stuttgart (DE)

(72) Inventor: Ralph Dammertz, Palatine, IL (US)

(73) Assignee: Robert Bosch GmbH, Stuttgart (DE)

( * ) Notice: Subject to any disclaimer, the term of this patent is extended or adjusted under 35 U.S.C. 154(b) by 128 days.

(21) Appl. No.: 14/109,947

(22) Filed: Dec. 17, 2013

(65) Prior Publication Data

US 2014/0182436 A1 Jul. 3, 2014

Related U.S. Application Data

(60) Provisional application No. 61/747,395, filed on Dec. 31, 2012, provisional application No. 61/781,341, filed on Mar. 14, 2013.

(51) Int. Cl.
*B27B 27/10* (2006.01)
*B27B 27/02* (2006.01)

(52) U.S. Cl.
CPC ..... *B27B 27/10* (2013.01); *B27B 27/02* (2013.01); *Y10T 83/73* (2015.04)

(58) Field of Classification Search
CPC .... B23Q 3/005; Y10T 83/727; Y10T 83/773; B27B 27/02; B27B 27/10
USPC ..... 83/440, 446, 477.2
See application file for complete search history.

(56) References Cited

U.S. PATENT DOCUMENTS

| | | | | | |
|---|---|---|---|---|---|
| 1,926,828 | A | * | 9/1933 | Van Berkel | 83/713 |
| 2,075,282 | A | * | 3/1937 | Hedgpeth | 83/438 |
| 2,166,703 | A | * | 7/1939 | Boice | 83/438 |
| 2,325,082 | A | * | 7/1943 | Tautz | 83/438 |
| 2,556,548 | A | * | 6/1951 | Modderman | 83/438 |
| 2,562,246 | A | * | 7/1951 | Van Dam et al. | 83/438 |
| 2,677,400 | A | * | 5/1954 | Gaskell | 83/438 |

(Continued)

FOREIGN PATENT DOCUMENTS

WO WO2005/108031 * 11/2005 ..... B27B 27/02

OTHER PUBLICATIONS

International Search Report and Written Opinion corresponding to PCT Application No. PCT/US2013/077805, mailed Apr. 15, 2014 (9 pages).

*Primary Examiner* — Laura M Lee
(74) *Attorney, Agent, or Firm* — Maginot Moore & Beck LLP

(57) ABSTRACT

A rip fence for a table saw includes a frame having a front portion and a rear portion. A front clamping lever is pivotably supported in the front portion of the frame for movement between a clamped and an unclamped position. A handle is pivotably supported in the front portion of the frame for movement between a locked and an unlocked position. The handle includes a lever portion that engages the front clamping lever and moves the front clamping lever from the unclamped to the clamped position when the handle is moved from the unlocked position toward the locked position. A rear clamping lever is attached to the rear portion of the frame and movable between a clamped and unclamped position. When the front clamping lever is moved to clamped position by the lever portion of the handle, continued movement of the handle to locked position results in the handle pulling the rear clamping lever from the unclamped to the clamped position.

11 Claims, 9 Drawing Sheets

(56) References Cited

U.S. PATENT DOCUMENTS

| | | | | |
|---|---|---|---|---|
| 2,808,084 | A * | 10/1957 | Eschenburg et al. | 83/438 |
| 3,963,279 | A | 6/1976 | Eichler | |
| 4,521,006 | A * | 6/1985 | Waters | 269/304 |
| 4,696,213 | A * | 9/1987 | Conneally | 83/438 |
| 5,282,408 | A * | 2/1994 | Shiotani et al. | 83/432 |
| 6,360,641 | B1 * | 3/2002 | Talesky et al. | 83/438 |
| 8,240,237 | B2 | 8/2012 | Frolov | |
| 2005/0172773 | A1 | 8/2005 | Ku et al. | |
| 2009/0120255 | A1 * | 5/2009 | Lee | 83/438 |
| 2010/0122615 | A1 * | 5/2010 | Janson | 83/438 |
| 2011/0061508 | A1 * | 3/2011 | Scherl | 83/438 |
| 2012/0006170 | A1 | 1/2012 | Frolov et al. | |
| 2013/0174705 | A1 * | 7/2013 | Hendrickson et al. | 83/441.1 |
| 2014/0174273 | A1 * | 6/2014 | Frolov | 83/440 |

* cited by examiner

RIP FENCE FOR A TABLE SAW HAVING INDEPENDENT ALIGNMENT AND LOCKING

CROSS-REFERENCE TO RELATED APPLICATIONS

This application claims priority to U.S. Provisional Application Ser. No. 61/747,395 entitled "RIP FENCE FOR A TABLE SAW HAVING INDEPENDENT ALIGNMENT AND LOCKING" by Ralph Dammertz filed Dec. 31, 2012, and to U.S. Provisional Application Ser. No. 61/781,341 entitled "RIP FENCE FOR A TABLE SAW HAVING INDEPENDENT ALIGNMENT AND LOCKING" by Ralph Dammertz filed Mar. 14, 2013, the disclosures of which are each incorporated herein by reference in their entirety.

TECHNICAL FIELD

This disclosure relates generally to table saws, and particularly to rip fences for use with table saws.

BACKGROUND

Table saws of various designs include a frame and an upper surface having an opening through which a blade extends. The upper surface supports a material, such as wood, as it is pushed towards the blade for cutting. Table saws have traditionally been stand-alone pieces of equipment that are used in workshops. Because most stand-alone table saws are used in large open spaces, the dimensions of the table saw can be large enough to support materials of various sizes for cutting. Tables that are used in workshops are not readily moved from one location to another. At construction sites, it is useful to have a table saw that can be easily moved from one location to another or between different construction sites. Accordingly, smaller and portable table saws have been designed. These table saws use lighter materials and have reduced the dimensions of the frame and the upper surface to reduce the size and weight of the table saw thereby creating the desired portable table saw. The portable table saws also use a separable folding stand to hold the table saw at the correct height for operation.

An integral part of most table saws is a movable rip fence. The rip fence is positioned perpendicular to the upper cutting surface and is aligned generally parallel to the position of the blade. Most rip fences are designed to span between the front edge and the rear edge of the upper cutting surface. Moreover, the rip fence can be positioned in any position along the upper surface and is secured in such a position by a locking mechanism. The rip fence is usually secured in a position a given distance away from the blade and can be put on either side of the blade. When the rip fence is secured in a position, the wood can be pushed against the side of the rip fence to slide on the upper surface to be cut by the blade. Thus, accurate and straight cuts can be made.

Rip fences of various different designs are readily known in the prior art. In addition, different methods of securing the rip fence at a given location on the upper surface, including the use of a locking mechanism, are known. One of the primary objectives for the rip fence is for it to be generally parallel to the blade so that the most accurate cuts can be made. It is known that an effective way to make the rip fence parallel with the blade is to force it to be perpendicular to the front and rear edge surfaces of the table saw. Thus, many rip fences use a front locking mechanism and a rear locking mechanism. The front locking mechanism presses against the front edge surface and the rear locking mechanism presses against the rear edge surface. In this way, the locking mechanism aligns the rip fence perpendicular to the edge surfaces and parallel to the blade.

It is also helpful to properly align the rip fence if the front and rear locking mechanism move simultaneously. To achieve this, rip fences typically include a handle which is connected to the front locking mechanism and a rod that connects between the handle and the rear locking mechanism. When the handle is in a first and released position, the front locking mechanism is positioned in a released position relative the front edge surface and the rod reduces pressure and allows the rear locking position to move into a released position relative the rear edge surface. When the handle is in a second and locked position, the front locking mechanism is positioned in a locked position along the front edge surface and the rod pushes the rear locking mechanism into the locked position. As the handle moves from the released to the locked position, the front and rear locking mechanism engage with the front and rear edges at the same time.

Different types of front and rear locking mechanisms are known. Some front locking mechanisms include a cam that is connected to a handle such that when the handle is put into the locked position, the cam is pushed against a surface on the front edge of the table saw to secure the rip fence in position. FIGS. 12-14 depict one type of previously known rip fence in a locked position. The rip fence 120 of FIGS. 12-14 includes a front locking mechanism 122 and a rear locking mechanism 124. The front locking mechanism 122 includes a frame 126, a handle 128, a linkage 130, a cam 132, a lever 134, and a spring plate 136. The handle 128 is pivotally connected to the frame 126 at a pivot point 138, the cam 132 is pivotally connected to the frame 126 at pivot point 140, and the lever 134 is pivotally connected to the frame 126 at point 142. The linkage 130 is attached at one end to the handle 128 and at the other end to the cam 132. The rear locking mechanism 124 includes a frame 142 and a clamping lever 144. The rear clamping lever 144 is pivotally connected to the frame 142 at a pivot point 146. The front and rear locking mechanisms 122, 124 are coupled together by a clamping rod 148 that extends between and connects the lever 134 of the front locking mechanism 122 to the lever 144 of the rear locking mechanism 124.

When the handle 128 is pivoted upwardly from the locked position about pivot point 138, the linkage 130 pulls cam 132 causing the cam 132 to pivot about pivot point 140. The cam 130 is positioned to actuate the lever 134 causing the lever to pivot about pivot point 142. The lever 134 does two things. First, it pushes the spring plate 136 against the front rail (not shown) of the table saw creating a spring force which causes the guide block to be pulled against the rail thus aligning the frame (and the overall fence) with the rail (and the blade). Second, it pulls the clamping rod 148. The clamping rod 148 in turn pivots the rear clamping lever 144 about the pivot point 146 into engagement with the rear guide rail of the table saw.

While effective, there is no separation between the alignment force generated by the spring plate 136 and the locking force generated by the rear clamping lever 144 when locking the fence onto the rails. The spring plate 136 and the rear clamping lever 144 are both controlled by the cam 132 and lever 134 action. Therefore, the system must be balanced between alignment force in the spring and clamping force in the rear clamping lever. An increase in clamping force may result in a decrease in alignment force as the rear of the fence may clamp before the spring creates enough force to move/align the rip fence. Conversely, increasing the alignment force may result in the spring touching the front rail when the system is unlocked which can result in damage to the rail as well as unpleasant noises and/or vibrations when the position of the fence is adjusted.

DRAWINGS

DESCRIPTION

Figure 1:
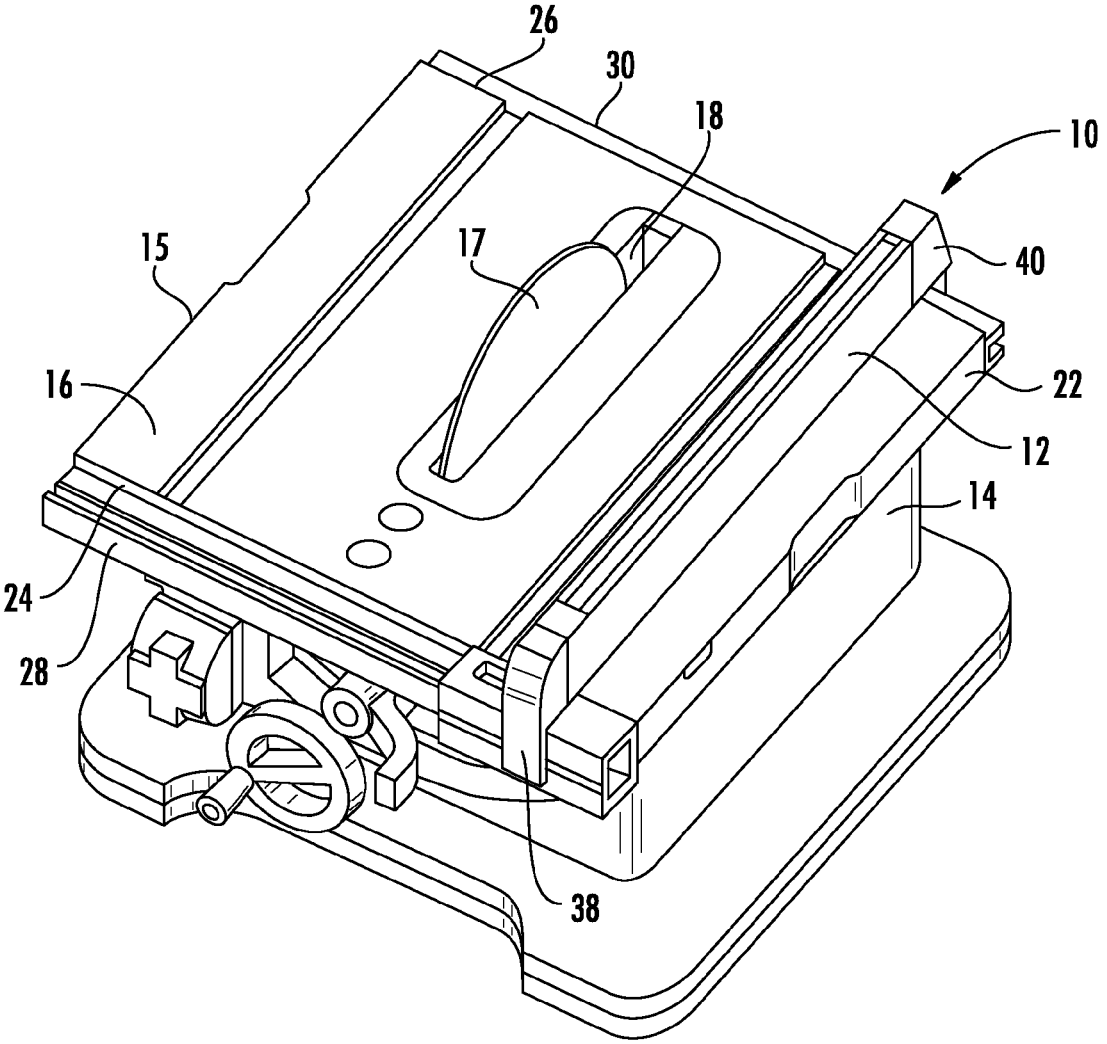
FIG. 1 depicts a table saw including a rip fence in accordance with the present disclosure.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles of the disclosure as would normally occur to one of ordinary skill in the art to which this disclosure pertains.

In accordance with one embodiment of the present disclosure, a rip fence for a table saw includes a frame having a front portion and a rear portion. A front clamping lever is pivotably supported in the front portion of the frame for movement between a clamped and an unclamped position. A handle is pivotably supported in the front portion of the frame for movement between a locked and an unlocked position. The handle includes a lever portion that engages the front clamping lever and moves the front clamping lever from the unclamped to the clamped position when the handle is moved from the unlocked position toward the locked position. A rear clamping lever is attached to the rear portion of the frame and movable between a clamped and unclamped position. When the front clamping lever is moved to clamped position by the lever portion of the handle, continued movement of the handle to locked position results in the handle pulling the rear clamping lever from the unclamped to the clamped position.

In accordance with another embodiment, a table saw includes a table having an upper surface and defining a blade opening. A cutting assembly is supported below the table and includes a saw blade that extends upwardly through the blade opening. A front guide rail is attached to a front edge portion of the table, and a rear guide rail is attached to a rear edge portion of the table. A rip fence is slidably supported by the front guide rail and the rear guide rail. The rip fence includes a frame having a front portion and a rear portion. A front clamping lever is pivotably supported in the front portion of the frame for movement between a clamped and an unclamped position. A handle is pivotably supported in the front portion of the frame for movement between a locked and an unlocked position. The handle includes a lever portion that engages the front clamping lever and moves the front clamping lever from the unclamped to the clamped position when the handle is moved from the unlocked position toward the locked position. A rear clamping lever is attached to the rear portion of the frame and movable between a clamped and unclamped position. The front clamping lever is configured to be moved into and out of engagement with the front guide of the table saw when moved between the clamped and the unclamped positions. The rear clamping lever is configured to be moved into and out of engagement with the rear guide of the table saw when moved between the clamped and unclamped positions. When the front clamping lever is moved to clamped position by the lever portion of the handle, continued movement of the handle to locked position results in the handle pulling the rear clamping lever toward the front portion of the frame and into the clamped position.

FIG. 1 illustrates a table saw 10 having a rip fence 12 in accordance with the principles of the present invention. The table saw 10 can be of any known type such as a stand-alone table saw or a portable table saw. The table saw 10 includes a frame 14 and a main table 15. The frame defines an enclosure space (not visible) where the components of the cutting assembly, such as a motor (not shown), drive system (not shown), bevel and blade height adjustment system (not shown), and circular saw blade 17, are mounted. The main table 15 is supported on the frame 14 above the cutting assembly and includes a generally planar upper surface 16 that serves as a workpiece support surface. The circular saw blade 17 extends upwardly through a blade opening 18 defined in the main table 15.

In one embodiment, as seen in FIG. 1, the table saw includes an extension table 22 that is movable between a position adjacent the upper cutting surface and an extended position separated from the main table 15. The main table and extension table each include a front edge portion 24 and a rear edge portion 26. A front rail 28 is secured to the front edge portion 24, and a rear rail 30 is secured to the rear edge portion 26. The rails 28, 30 are configured to interact with the locking mechanisms 38, 40 of the rip fence 12.

Referring to FIGS. 2-10, the front rail 28 includes an upwardly extending guide flange 32 that extends longitudinally along the outer portion of the front rail 28. The guide flange 32 includes a first inner surface 33 that faces toward the table saw 10 and a second inner facing surface 43 that faces away from the table saw 10. The first inner surface 33 and second inner surface 43 define an upward facing slot 34 therebetween (See, e.g., FIG. 3). The inner surface 33 includes a recessed portion that forms a groove 37 located near the bottom surface of the slot 33. The guide flange 32 also includes an outer surface 35 that faces away from the table saw 10. The guide flange 32 and the slot 34 are configured to interact with the front locking mechanism 38 of the rip fence 12. The rear rail 30 extends longitudinally along the rear edge portion 26 of the main table 15 and extension table 22 and includes features, such as a slot or groove 31 (See, e.g., FIG. 2), for interacting the rear locking mechanism 40 of the rip fence 12.

Referring to FIGS. 2-10, the rip fence 12 includes a main casing 36, a front locking mechanism 38, a rear locking mechanism 40, a handle 44, a linkage 46, 64, and a bearing and alignment assembly 80. The main casing 36 has a generally rectangular form and is configured to extend longitudinally between the front edge portion 24 and rear edge portion 26 of the main table 15. The front locking mechanism includes a front clamping lever 48 that is movable into and out of engagement with the front guide rail 28, i.e., between a clamped and unclamped position, about a pivot point 66. The rear locking mechanism 40 is attached to the rear end of the main casing 36 and includes a rear clamping lever 88 that is movable into and out of engagement with the rear rail 30, i.e., between a clamped and unclamped position, about a pivot point 98. Alternatively, the front and rear clamping levers 48, 88 may be configured for sliding movement into and out of engagement with the front and rear guide rails.

Figure 9:
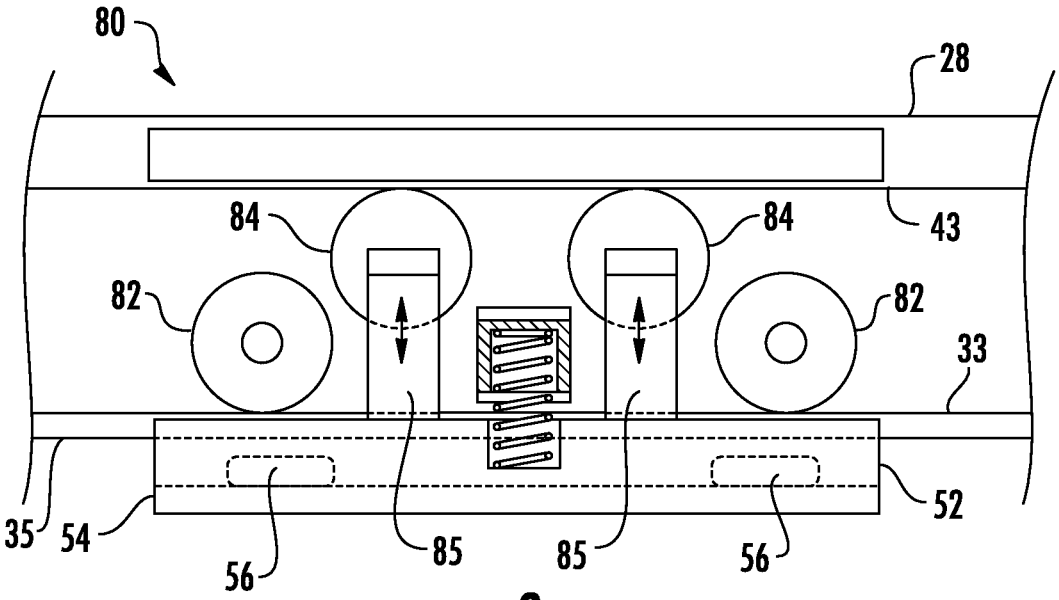
FIG. 9 depicts the bearing and alignment assembly of the rip fence of FIG. 2 when the locking mechanisms are in the unlocked positions of FIGS. 3 and 4.
Figure 10:
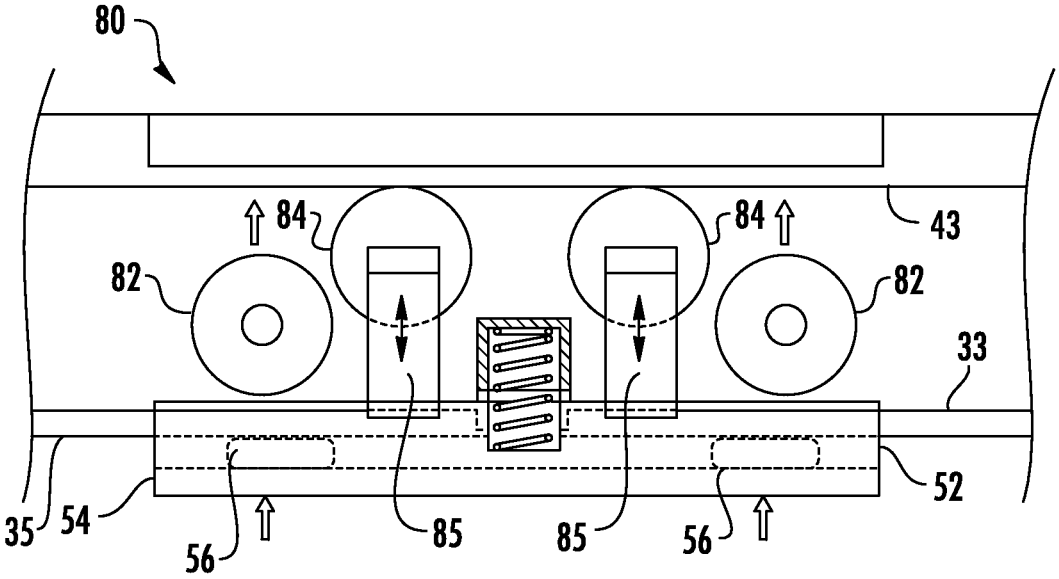
FIG. 10 depicts the bearing and alignment assembly of the rip fence of FIG. 2 when the locking mechanisms are in the locked positions of FIGS. 7 and 8.
Figure 11:
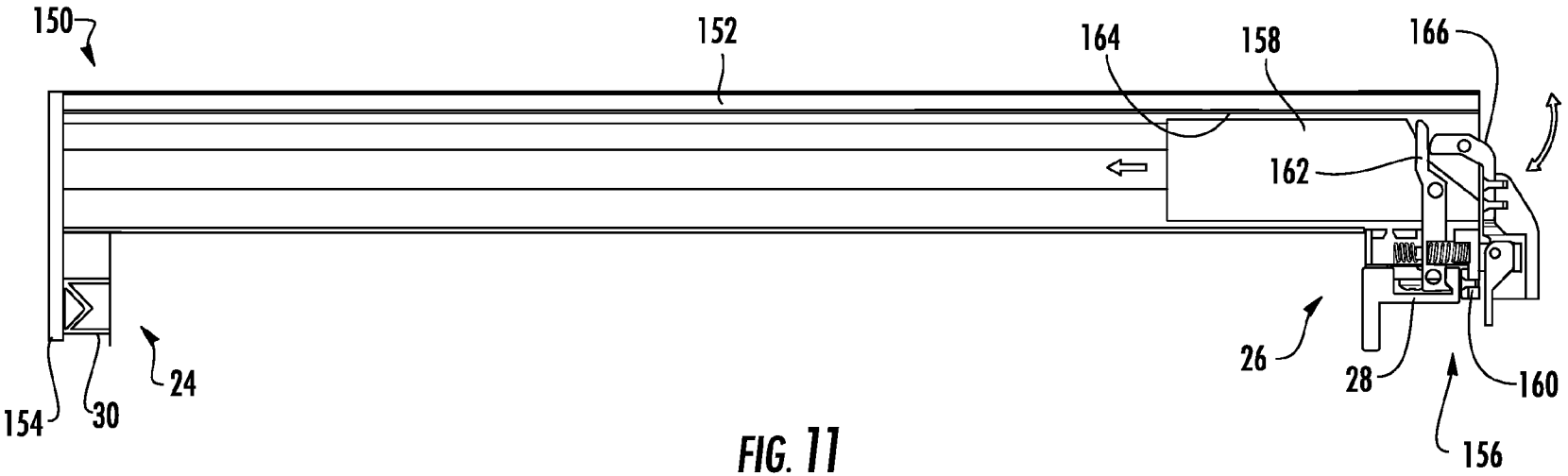
FIG. 11 depicts another embodiment of a rip fence for use with the table saw of FIG. 1.
Figure 12:
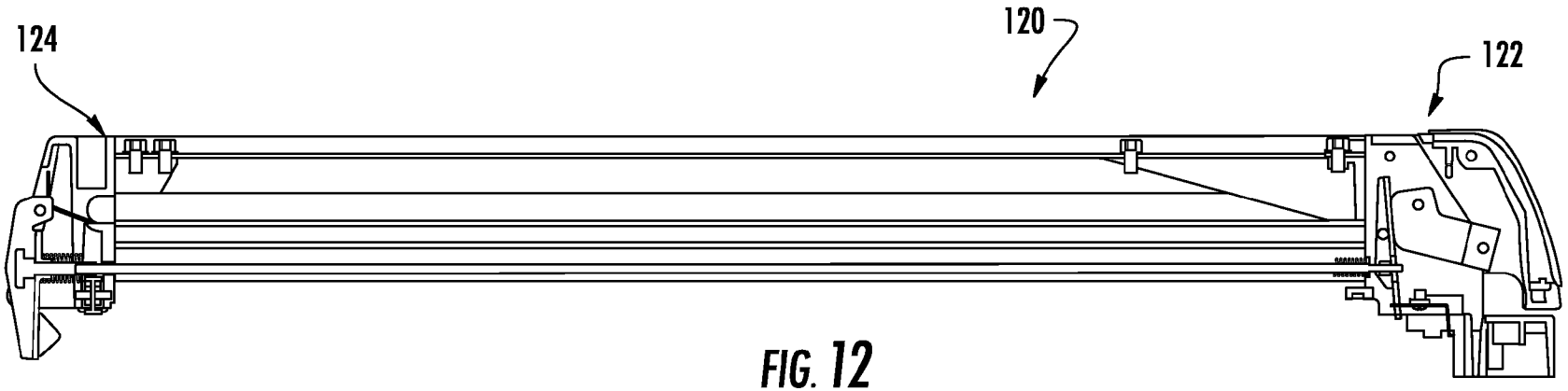
FIG. 12 (PRIOR ART)
FIG. 12 depicts a side cross-sectional view of a rip fence according to the prior art.
Figure 13:
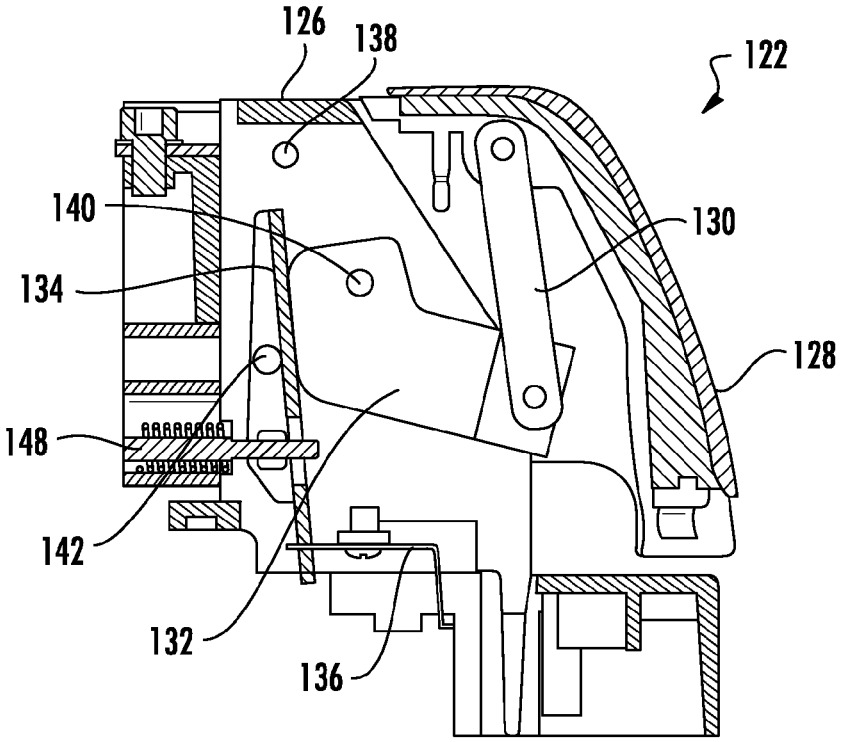
FIG. 13 (PRIOR ART)
FIG. 13 depicts a side cross-sectional view of the front locking mechanism of the prior art rip fence of FIG. 12.
Figure 14:
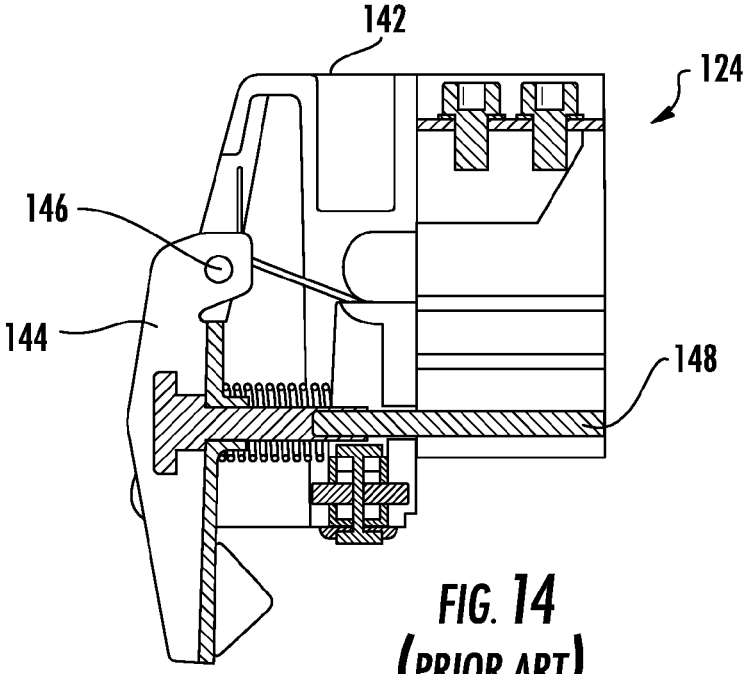
FIG. 14 (PRIOR ART)
FIG. 14 depicts a side cross-sectional view of the rear locking mechanism of the prior art rip fence of FIG. 12.

The handle 44 is pivotably attached to the front end portion of the casing 36 for pivotable movement about a third pivot point 62 between a locked and an unlocked position. The handle includes a lever portion 58 that engages the front clamping lever and moves the front clamping lever from the unclamped position to the clamped position when the handle is moved from the unlocked position toward the locked position. A linkage couples the handle 44 and the rear clamping lever 88 so that, when the handle is moved to the locked position, the rear clamping lever 88 is also moved from the unclamped to the clamped position. In the embodiment of FIGS. 2-10, the linkage comprises a rod 64 and bracket 46. In the embodiment of FIG. 11, the linkage comprises the casing of the fence itself.

In the clamped position, the front and rear locking mechanisms 38, 40 are configured to secure the rip fence to the rails 28, 30. In the unclamped position, the rip fence is allowed to slide along the rails 28, 30 by the bearing and alignment assembly 80 to allow the rip fence 12 to be positioned a desired distance from the blade 17. The front and rear locking mechanisms 38, 40 are not used to align the rip fence. As explained below, the bearing and alignment assembly 80 is configured to generate an alignment force that maintains the rip fence at a desired orientation with respect to the table saw, e.g., parallel to the blade, while the rip fence is being moved. The front and rear locking mechanisms 38, 40 are configured to engage the front and rear rails 28, 30 to secure the rip fence in position on the table saw without altering the alignment generated by the bearing and alignment assembly 80.

Referring to FIGS. 2, 3, 5, and 7, the front locking mechanism 38, the handle 44, and the bearing and alignment assembly 80 are supported by a front frame 42. The front frame 42 is attached to the front end of the main casing 36 and defines an interior space 50 for receiving the components of the front locking mechanism 38. The front frame 42 is supported on an L-shaped member 52. The L-shaped member 52 includes a clamping portion 54 that extends downwardly from the frame 42 adjacent to the outer surface 35 of the guide flange 32. The clamping portion 54 includes a clamping pad 56, e.g., rubber or plastic, that is pressed against the outer surface 35 of the guide flange 32 during clamping.

The handle 44 is configured to pivot with respect to the front frame 42 between an upward position (FIG. 3), or unlocked position, and a lower position (FIG. 7), or locked position. The handle 44 includes a lever portion 58 that extends through a front opening 60 of the front frame 42 into the interior space 50 where it is pivotally attached to the linkage. In the embodiment of FIGS. 2-10, the linkage comprises a clamping bracket 46 and a clamping rod 64 that are used to operably connect the front and rear locking mechanisms 38, 40. The handle is pivotably attached to the clamping bracket 46 at the pivot point 62. The clamping rod 64 is coupled at one end to the clamping bracket 46 and coupled at the other end to the rear clamping lever 88 in the rear locking mechanism 40 (See, e.g., FIG. 2). The clamping bracket 46 and clamping rod 64 are configured to translate axially within the casing to allow the pivot point 62 to move with respect to the pivot points 62, 98 of the front and rear clamping levers 48, 88.

Figure 7:
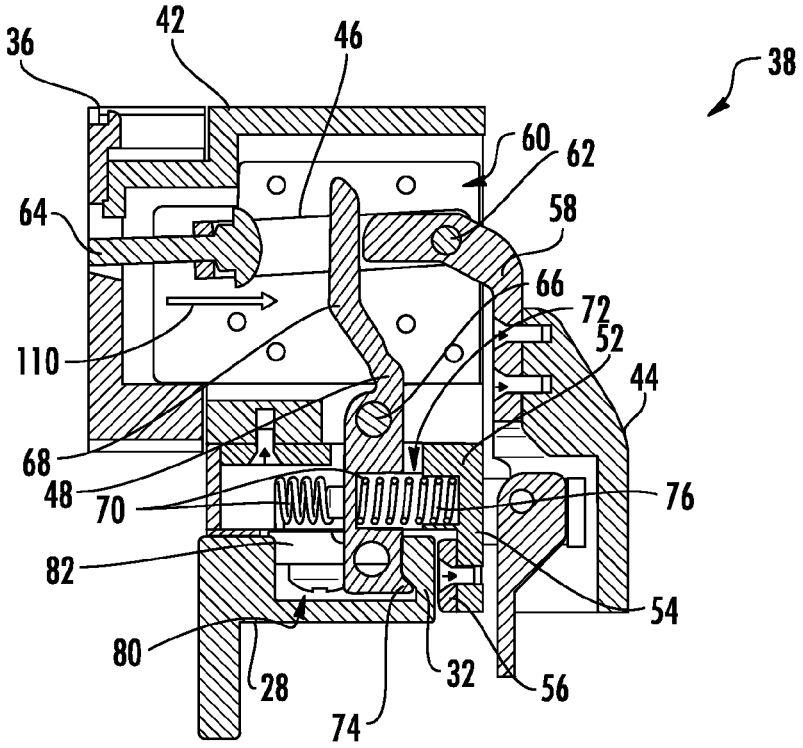
FIG. 7 depicts a side cross-sectional view of the front locking mechanism of the rip fence of FIG. 2 in a locked position.

The clamping bracket 46 and clamping rod 64 are supported for movement between a rearward position (FIG. 3) and forward position (FIG. 7). In the rearward position, the rear clamping lever 88 is in a released position, and in the forward position, the rear clamping lever 88 is in a clamped position. The clamping rod 64 can have any suitable configuration and can extend, as a single rod, down the center or along an inner sidewall of the casing. In one embodiment, a pair of clamping rods (not shown) may be used that extend along each inner sidewall of the casing with the clamping bracket configured as a yoke in order to move them both simultaneously.

The front clamping lever 48 is pivotally attached to the front frame 42 at a pivot point 66 located in a middle portion of the front clamping lever 48. The front clamping lever 48 includes an upper portion 68 and a lower portion 70. The upper portion 68 extends generally upwardly from the pivot point 66 to a position where it can be engaged by the lever portion 58 of the handle 44. The lower portion 70 extends generally downwardly from the pivot point 66 through a passage 72 that extends through the bottom of the front frame 42 and through the L-shaped member 52 and is received in the slot 34 of the front guide rail 28.

Figure 3:
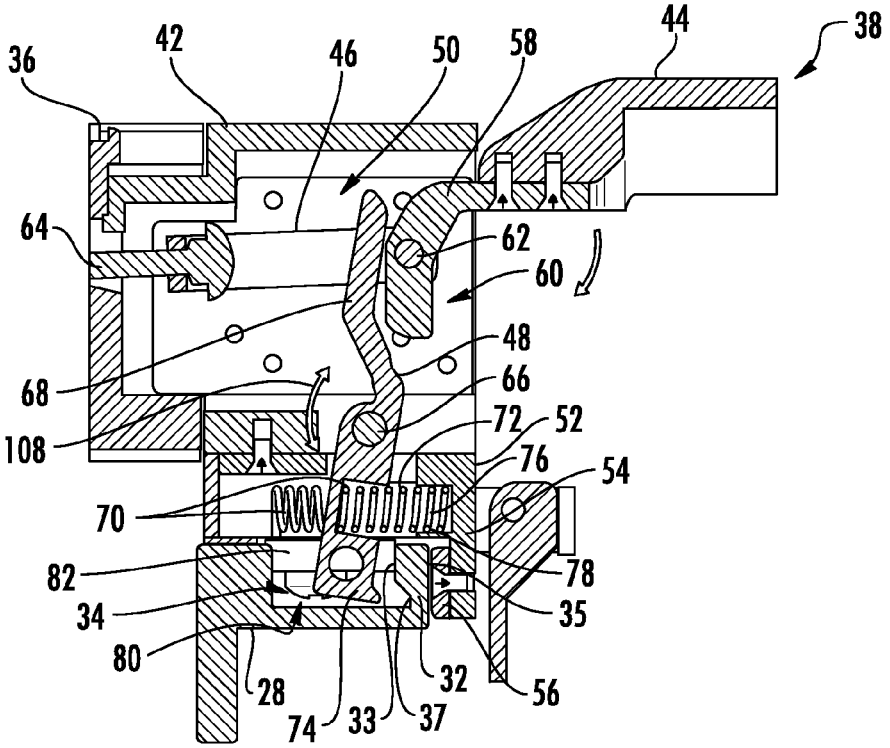
FIG. 3 depicts a side cross-sectional view of the front locking mechanism of the rip fence of FIG. 2 in an unlocked position.

The front clamping lever 48 is configured to pivot with respect to the front frame 42 between a clamped position (FIG. 7) and a released position (FIG. 3). In the clamped position, the lower portion 70 of the front clamping lever 48 is positioned in engagement with the inner surface 33 of the guide flange 32. In the released position, the lower portion 70 of the front clamping lever 48 is spaced apart from the inner surface 33 of the flange 32. The lower portion 70 of the front clamping lever 48 may include a projection 74 that is sized and positioned to be received in the groove 37 (See, e.g., FIG. 3) defined in the inner surface 33 of the guide flange 32 when the front clamping lever 48 is in the locked position.

Figure 2:
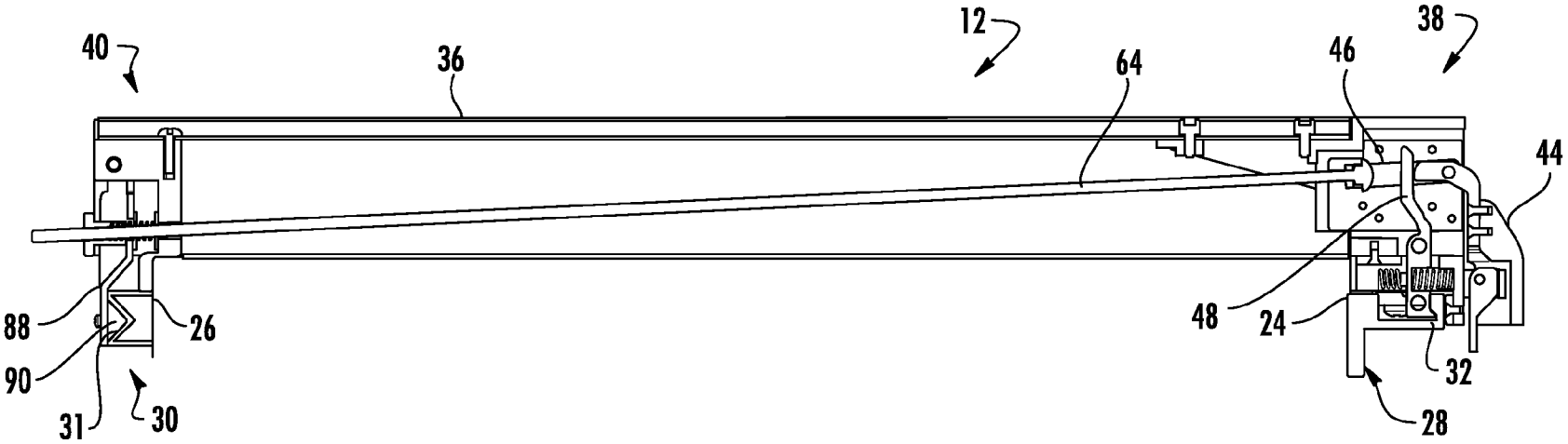
FIG. 2 depicts a side cross-sectional view of rip fence of FIG. 1.

The lever portion 58 of the handle 44 has a cam-shaped portion that is configured to interact with the upper portion 68 of the front clamping lever 48. As can be seen in FIG. 3, when the handle 44 is in the upward, unlocked position, the lever portion 58 of the handle 44 is configured to allow the upper portion 68 of the front clamping lever 48 to move to the released position. The lower portion 70 of the front clamping lever 48 is biased away from the inner surface 33 of the guide flange 32 by a biasing member 76, such as a coil spring. The coil spring 76 is positioned between the clamping portion 54 of the L-shaped member 52 and the lower portion 70 of the front clamping member 48 so that the coil spring 76 is compressed when the lower portion moves toward the guide flange 32. When the handle 44 is in the upward position, the spring 76 is allowed to decompress and return the front clamping lever 48 to the released position. As depicted, the coil spring 76 is received in a recess 78 defined in the lower portion 70 of the clamping lever 48. In alternative embodiments, any suitable type of biasing member or biasing configuration may be used. Referring to FIGS. 2, 4, 6, and 8, the rear locking mechanism 40 includes a rear frame 86, a rear clamping lever 88, and a friction block 90. The rear frame 86 is attached to the rear end portion of the casing 36 and defines an interior space 92 for receiving and mounting the components of the rear locking mechanism 40. The rear clamping lever 88 includes an upper portion 94 and a lower portion 96. The upper portion 94 of the rear clamping lever 88 is pivotally attached to the rear frame 86 at pivot point 98 and extends downwardly through an opening 102 in the bottom of the rear frame 86 to a position adjacent to the rear guide rail 30 (FIG. 2).

Figure 4:
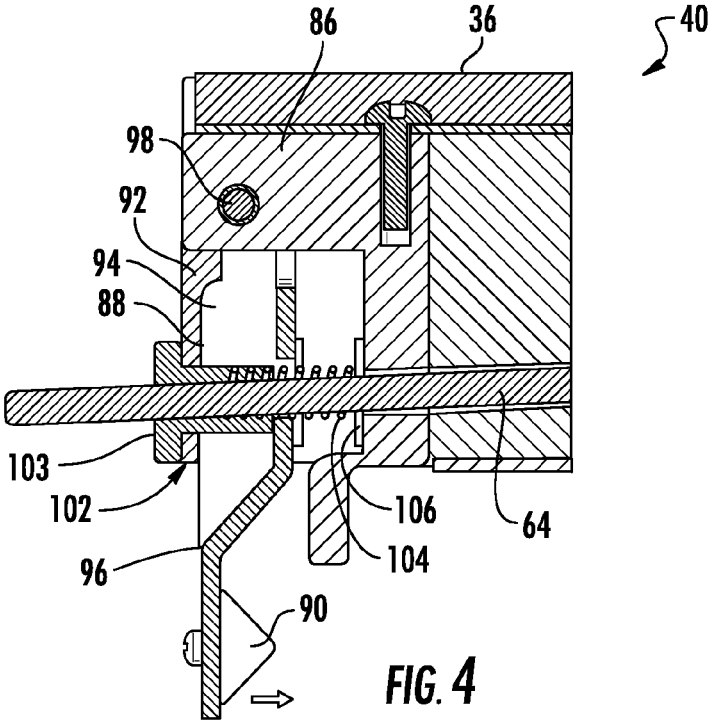
FIG. 4 depicts a side cross-sectional view of the rear locking mechanism of the rip fence of FIG. 2 in an unlocked position.

The clamping rod 64 extends into the interior space 92 of the rear frame 86 where it is attached to an intermediate portion of the rear clamping lever 88. The rear clamping lever 88 is configured to be pivoted about the pivot point 98 by the clamping rod 64 between a clamped position (FIG. 8) and a released position (FIG. 4). In the released position, the lower portion 96 of the rear clamping lever 88 is spaced apart from the rear rail 30. In the clamped position, the lower portion 96 is pivoted into engagement with the rear rail 30. The friction block 90 is attached to the lower portion 96 of the rear clamping lever 88 in order to engage the rear rail 30 when the rear clamping lever 88 is in the clamped position. As depicted in FIG. 2, the friction block 90 may be received in the groove 31 defined in the rear rail 30.

A biasing member 104, such as a coil spring, is positioned to bias the rear clamping lever 88 toward the released position. The biasing member 104 is located between the rear clamping lever 88 and an inner wall 106 of the rear frame 86 so as to be compressed when the lower portion 96 of the rear clamping lever 88 is pivoted toward the rear rail 30. The biasing member 104 also serves to bias the clamping bracket 46 toward the rearward position (FIG. 3). In alternative embodiments, the rear clamping lever 88 and clamping bracket 46 may be biased toward the released and rearward positions, respectively, in any suitable manner.

The bearing and alignment assembly 80 is attached to the L-shaped member 52. When the front and rear locking mechanisms 38, 40 are in unlocked positions as depicted in FIGS. 3 and 4, respectively, the bearing and alignment assembly 80 is configured to allow the rip fence 12 to slide along the guide rails while simultaneously maintaining the rip fence in alignment with the saw blade. As depicted in FIGS. 9 and 10, the bearing and alignment assembly 80 includes a pair of fixed or stationary roller bearings 82 and a pair of spring-loaded roller bearings 84. The stationary roller bearings 82 are mounted in a fixed position to the L-shaped member 52 for engaging the first inner surface 33 of the guide rail 28. The spring-loaded bearings 84 are mounted to the L-shaped member 52 by spring-loading mechanisms 85 which load the bearings 84 against the second inner surface 43 at all times.

When the locking mechanisms 38, 40 are in unlocked positions (FIGS. 3 and 4), the spring-loading mechanisms 85 are configured to load the bearings 84 against the second inner surface 43 of the slot 34 with sufficient force to push the L-shaped member 52 away from the main table 15. This results in the stationary bearings 82 being moved into engagement with the first inner surface 33 of the slot 34 to serve as alignment bearings as depicted in FIG. 9. When the stationary bearings 82 are positioned in engagement with the first inner surface 33 and the spring-loaded bearings 84 are loaded against the second inner surface 43 as depicted in FIG. 9, the force generated by the spring-loading mechanisms 85 serves as an alignment force for maintaining the rip fence 12 at a fixed orientation with respect to the main table 15 and the blade 17. This orientation is maintained while the roller bearings 82, 84 are slid along the inner surfaces 33, 43 of the slot 34 when adjusting the position of the rip fence 12.

The force generated by the spring-loading mechanisms 85 must be overcome to bring the clamping pads 56 on the clamping portion 54 of the L-shaped member 52 into pressing engagement with the outer surface 35 of the front guide rail 28 as depicted in FIG. 10. The configuration of the front and rear locking mechanisms 38, 40 enables the force of the spring-loading mechanisms 85 to be overcome so that the fence 12 can be locked in position without altering the alignment of the rip fence. This is achieved by a design that allows both front and rear clamping levers 48, 88 to engage with the respective rails 28, 30 and apply force against them while the roller bearings 82, 84 are still loaded against the inner surfaces 33, 43 of the front guide rail 28.

After the front and rear clamping levers 48, 88 have engaged the front and rear guide rails 28, 30 and applied a clamping force thereto, further clamping force overcomes the spring force of the spring-loading mechanisms 85 and causes the rip fence 12 to slide forward a small distance. This results in the stationary bearings 82 being moved away from the first inner surface 33 of the front guide rail and brings the clamping pads 56 into engagement with the outer surface 35 of the front guide rail 28 so that the rip fence 12 can be locked in position. Because front and rear contact in conjunction plus clamp force is required to disengage the stationary alignment bearings, the fence does not change alignment in the locking phase. Once the fence is fully locked, alignment is secured mainly by clamping force and the front pads 56 are pressed against the outside of the front rail, further supporting the alignment.

Figure 5:
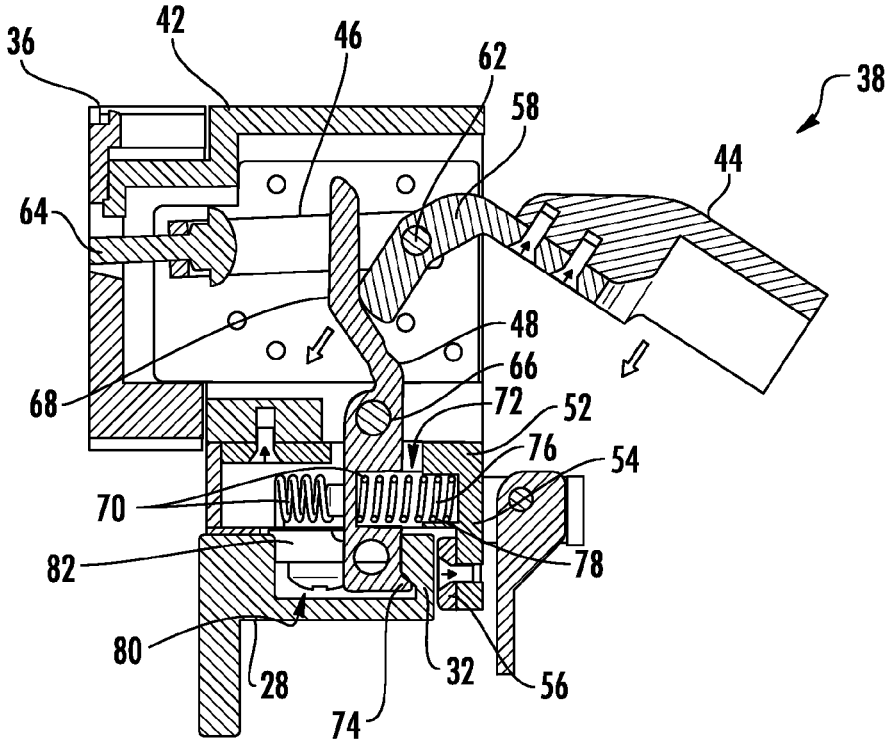
FIG. 5 depicts a side cross-sectional view of the front locking mechanism of the rip fence of FIG. 2 in an intermediate position.

To bring the front and rear clamping levers 48, 88 into engagement with the front and rear rails 28, 30, the handle 44 is pivoted downwardly from the upward position depicted in FIG. 3 to the intermediate position depicted in FIG. 5. In the intermediate position, the cam-shaped lever portion 58 of the handle 44 engages the upper portion 68 of the front clamping lever 48 and causes the front clamping lever 48 to pivot about the pivot point 66 in direction indicated by arrow 108. As a result, the lower portion 70 of the front clamping lever 48 is pivoted into engagement with the inner surface 33 of the guide flange 32.

Figure 6:
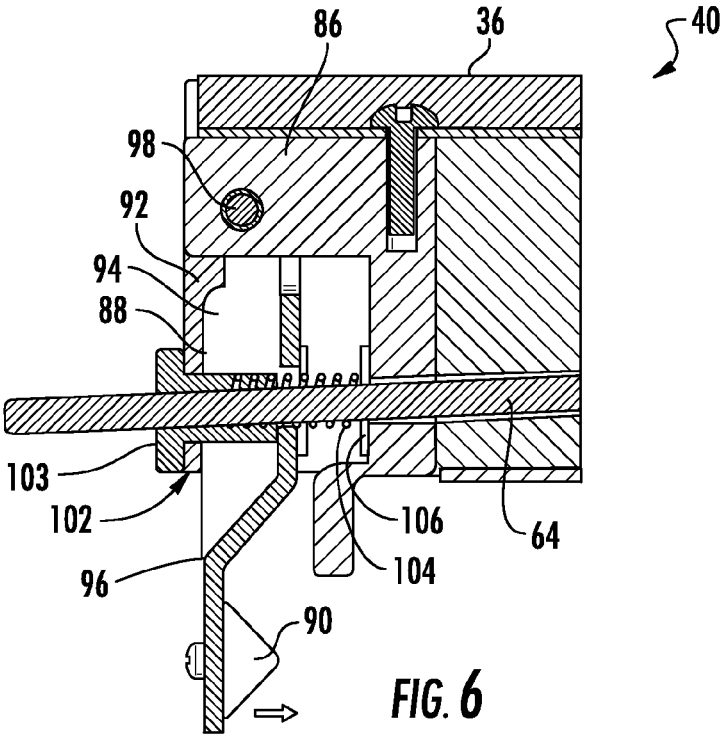
FIG. 6 depicts a side cross-sectional view of the rear locking mechanism of the rip fence of FIG. 2 in an intermediate position.

As the handle 44 pivots downwardly, the lever portion 58 of the handle is leveraged against the upper portion 68 of the front clamping lever 48. As a result, force exerted against the upper portion 68 of the front clamping lever 48 by the lever portion 58 of the handle 44 is converted to a pulling force on the clamping bracket 46 in direction 110. Thus, as the handle 44 is pivoted downwardly from the unlocked position (FIG. 3) to the intermediate position (FIG. 5), the lever portion 58 of the handle 44 pulls the clamping bracket 46 from the rearward position toward the forward position. The clamping bracket 46 in turn pulls the clamping rod 64 in direction toward the front of the table saw 10. As the clamping rod is pulled in direction 110, the rear clamping lever 88 of the rear locking mechanism is pivoted from the released position (FIG. 4) to the intermediate position (FIG. 6). When the front and rear clamping levers 48, 88, are in the intermediate position (FIGS. 5 and 6, the stationary roller bearings 82 are still engaged with the first inner surface 33 of the front guide rail 28 and the clamping pads 56 are still spaced apart from the outer surface of the front guide rail 28 as depicted in FIG. 9.

Continued movement of the handle 44 downwardly from the intermediate position (FIG. 5) toward the locked position (FIG. 7) with the lever portion 58 of the handle leveraged against the upper portion 68 of the front clamping lever 48 results in more pulling force being applied to the to the clamping bracket 46, clamping rod 64, and rear clamping lever 88. With the front and rear clamping levers 48, 88 clamped against the front and rear guide rails, the pulling force overcomes the spring force of the spring-loading mechanisms 85 and results in the rip fence 12 sliding in a direction from the front to the rear of the table until the clamping pads 56 are pressed against the outer surface 35 of the front guide rail 28 as depicted in FIG. 10. This action is enabled in part by the geometries of the front and rear lever arms and the length of the clamping rod/bracket. In one embodiment, the front and rear levers are configured so that the front lever exerts a substantially larger force onto the rail surface 34 than the rear lever exerts onto the rear rail, e.g., 2-3 times as much. As a result, the whole fence assembly slides toward the rear of the table until the clamping pads 56 on the clamping portion 54 of the L-shaped member 52 are brought into contact with the outer surface 35 of the front rail.

Figure 8:
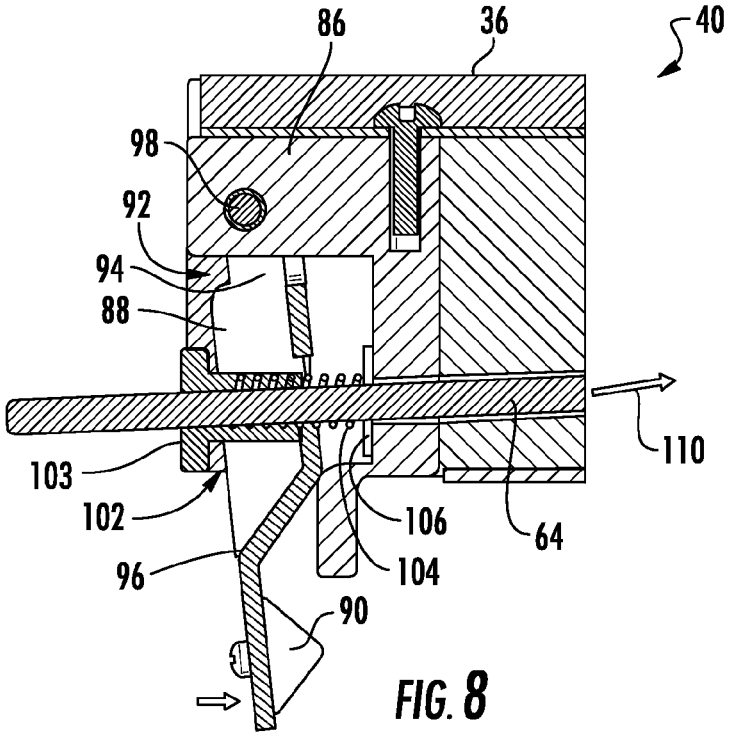
FIG. 8 depicts a side cross-sectional view of the rear locking mechanism of the rip fence of FIG. 2 in a locked position.

Once the clamping pads 56 are moved into engagement with the outer surface 35 of the front guide rail 28, further movement of the handle to the fully closed position (FIG. 7) requires compliance which is built into the system by the geometries and movement paths of the components and linkages in the system. This compliance is used to generate the final clamping force applied by the clamping portion 54/clamping pads 56 and the rear clamping lever 88 against the outer surface 35 of the front rail 28 and the rear rail 30, respectively. In one embodiment, the amount of clamping force generated by the assembly can be adjusted by lengthening or shortening the clamping rod 64. As one example of how this can be accomplished, the clamping rod 64 may be provided with a threaded end portion that is received in a complementarily threaded fastener structure 103 incorporated into the rear locking mechanism 40 as depicted in FIGS. 4, 6, and 8.

In the embodiment of FIGS. 2-10, the linkage comprises a longitudinally extending structure that mechanically couples the locking mechanisms in a rigid frame. In alternative embodiments, the fence may comprise a front frame portion and a rear frame portion having a linkage that enables the front frame portion and rear frame portion to be moveable with respect to each other, e.g., by sliding within each other. In this embodiment, the rear clamping lever may be replace with a fixed clamping structure that is moved into and out of engagement with the rear guide rail as the front and rear frame portions are moved with respect to each other.

Referring now to FIG. 11, an alternative embodiment of a rip fence with independent alignment and locking is depicted. In this embodiment, the rip fence 150 includes a fence 152, a rear clamping lever 154, and a front clamping mechanism 156. The fence 152 comprises a body, e.g., frame or casing, that extends substantially all the way across the table from the front edge 24 to the rear edge 26. The rear clamping lever 154 extends downwardly from the fence to a position adjacent the rear guide rail (FIG. 2). However, in this embodiment, the rear clamping lever 154 is fixedly attached to the rear end portion of the fence 152 is and is not configured to pivot with respect to the fence. In this embodiment, the casing of the fence 152 that extends from the front clamping mechanism to the rear end portion of the fence form the linkage between the handle and the rear clamping lever.

The front clamping mechanism 156 includes a fence insertion member 158, a front bracket member 160, and a front clamping lever 162. The fence insertion member 158 comprises a small piece that is configured to slide within a channel 164 in the casing of the fence 152. The front bracket member 160 is fixedly attached to the fence insertion member 158 and extends downwardly from the fence insertion member to a position adjacent an outer surface of the front guide rail 28. The front clamping lever 162 is pivotably attached to the fence insertion member 158 and extends downwardly from the fence insertion member to a position where it can be pivoted into and out of engagement with an inner surface of the front guide rail 28.

Because the fence 152 and rear clamping lever 154 are a solid piece, there is no need for a clamping rod. Rather, in this embodiment, the clamping handle 166 is pivotably attached to the front end portion of the fence 152. The clamping action of the clamping mechanism is still very similar to the other embodiments. As the handle 166 is pivoted downwardly from the open position towards the closed position, the lever portion of the handle 166 pushes the upper portion of the front clamping lever 162 and causes the front clamping lever 162 to pivot into engagement with the inner surface of the front guide rail 28.

Although not labeled in FIG. 11, the front clamping mechanism includes a bearing and alignment assembly, such as described above in conjunction with the FIGS. 2-10. As depicted in FIGS. 9 and 10, the bearing and alignment assembly includes spring loaded bearings (FIGS. 9 and 10) and stationary bearings that hold the hold the fence in alignment when the fence is unlocked and that enable the front clamping lever to be pivoted and brought into engagement with the front guide rail without upsetting the alignment of the fence.

After the front clamping lever 162 is pushed against the rail 28, continued movement of the handle to the closed position will cause the handle to pull the fence forward until the rear clamping lever engages the rear rail. After that, the front bracket member 160 will be brought into engagement with the outer surface of the front guide rail 28. Once the front bracket member 160 engages the front guide rail 28, additional clamping force is created through compliance in the system.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A rip fence for a table saw comprising:

a frame having a front portion and a rear portion;

a front clamping lever pivotably supported in the front portion of the frame for movement between a clamped and an unclamped position, the front clamping lever being configured to be moved into and out of engagement with a front guide of the table saw when moved between the clamped and the unclamped positions;

a handle pivotably supported in the front portion of the frame for movement between a locked and an unlocked position, the handle including a lever portion that engages the front clamping lever and moves the front clamping lever from the unclamped to the clamped position when the handle is moved from the unlocked position toward the locked position;

a rear clamping lever attached to the rear portion of the frame and movable between a clamped and unclamped position, the rear clamping lever being configured to be moved into and out of engagement with a rear guide of the table saw when moved between the clamped and unclamped positions;

a linkage that operatively couples the handle and the rear clamping lever;

a member configured to support the front portion of the frame, the member including a clamping portion extending downward from the frame adjacent to an outer surface of the front guide; and a bearing and alignment assembly attached to the clamping portion of the member, the bearing and alignment assembly including a plurality of roller bearings that are configured to slide within a slot defined in the front guide of the table saw, the plurality of roller bearings being configured to engage opposing surfaces of the slot to maintain the frame at a predetermined orientation with respect to the front guide and the rear guide when the handle is in the unlocked position, wherein the plurality of roller bearings includes:

at least one stationary roller bearing that is fixedly attached to the member for engaging a first inner surface of the slot; and at least one spring-loaded roller bearing that is spring-loaded against a second inner surface of the slot opposite the first inner surface; and wherein, when the front clamping lever is moved to the clamped position by the lever portion of the handle, continued movement of the handle to the locked position results in the handle pulling the linkage and the rear clamping lever toward the front portion of the frame and causes the rear clamping lever to move from the unclamped to the clamped position.

2. The rip fence of claim 1, wherein the handle is movable to an intermediate position between the locked position and the unlocked position, the lever portion of the handle configured to:

move the front clamping lever from the unclamped position to the clamped position and into engagement with the front guide as the handle is moved from the unlocked position toward the intermediate position, and move the rear clamping lever from the unclamped position to the clamped position and into engagement with the rear guide as the handle is moved from the intermediate position toward the locked position such that the rear clamping lever is moved and engaged with the rear guide after the front clamping lever is moved and engaged with the front guide as the handle is moved from the unlocked position toward the locked position.

3. The rip fence of claim 2, wherein the at least one spring-loaded roller bearing is configured to generate a spring force, wherein the lever portion of the handle includes a cam portion, the cam portion being configured to apply a first clamping force to the front clamping lever as the handle is moved from the unlocked position to the intermediate position and to apply a second clamping force to the front clamping lever as the handle is moved from the intermediate position to the locked position, wherein the first clamping force is less than the spring force, and wherein the second clamping force is greater than the spring force.

4. The rip fence of claim 3, wherein the front portion of the frame is slidable in relation to the rear portion of the frame, wherein the rear clamping lever is fixedly attached to the rear portion of the frame, and wherein the linkage comprises the rear portion of the frame.

5. The rip fence of claim 4, wherein the front portion of the frame includes an insertion member that is slidably received in a channel defined in the end rear portion of the frame.

6. The rip fence of claim 3, wherein the linkage comprises a rod that is coupled at one end to the handle and at another end to the rear clamping lever, wherein the rear clamping lever is pivotably attached to the rear end portion of the frame for pivotal movement between the clamped and unclamped positions, and wherein, when the front clamping lever is moved to clamped position by the lever portion of the handle, continued movement of the handle to locked position results in the handle pulling the rod and the rod in turn pivoting the rear clamping lever from the unclamped to the clamped position.

7. A table saw comprising:

a table including an upper surface and defining a blade opening;

a cutting assembly supported below the table and including a saw blade that extends upwardly through the blade opening;

a front guide rail attached to a front edge portion of the table;

a rear guide rail attached to a rear edge portion of the table; and a rip fence slidably supported by the front guide rail and the rear guide rail, the rip fence including:

a frame having a front portion and a rear portion;

a front clamping lever pivotably supported in the front portion of the frame for movement between a clamped and an unclamped position, the front clamping lever being configured to be moved into and out of engagement with the front guide rail when moved between the clamped and the unclamped positions;

a handle pivotably supported in the front portion of the frame for movement between a locked and an unlocked position, the handle including a lever portion that engages the front clamping lever and moves the front clamping lever from the unclamped to the clamped position when the handle is moved from the unlocked position toward the locked position;

a rear clamping lever attached to the rear portion of the frame and movable between a clamped and unclamped position, the rear clamping lever being configured to be moved into and out of engagement with the rear guide rail when moved between the clamped and unclamped positions;

a linkage that operatively couples the handle and the rear clamping lever;

a member configured to support the front portion of the frame, the member including a clamping portion extending downward from the frame adjacent to an outer surface of the front guide rail; and a bearing and alignment assembly attached to the clamping portion of the member, the bearing and alignment assembly including a plurality of roller bearings that are configured to slide within a slot defined in the front guide rail, the plurality of roller bearings being configured to engage opposing surfaces of the slot to maintain the frame at a predetermined orientation with respect to the front guide rail and the rear guide rail when the handle is in the unlocked position, wherein the plurality of roller bearings includes:

at least one stationary roller bearing that is fixedly attached to the member for engaging a first inner surface of the slot; and at least one spring-loaded roller bearing that is spring-loaded against a second inner surface of the slot opposite the first inner surface, wherein, when the front clamping lever is moved to the clamped position by the lever portion of the handle, continued movement of the handle to the locked position results in the handle pulling the linkage and the rear clamping lever toward the front portion of the frame and causes the rear clamping lever to move from the unclamped to the clamped position.

8. The table saw of claim 7, wherein the handle is movable to an intermediate position between the locked position and the unlocked position, the lever portion of the handle configured to:

move the front clamping lever from the unclamped position to the clamped position and into engagement with the front guide rail as the handle is moved from the unlocked position toward the intermediate position, and move the rear clamping lever from the unclamped position to the clamped position and into engagement with the rear guide rail as the handle is moved from the intermediate position toward the locked position such that the rear clamping lever is moved and engaged with the rear guide rail after the front clamping lever is moved and engaged with the front guide rail as the handle is moved from the unlocked position toward the locked position.

9. The table saw of claim 8, wherein the at least one spring-loaded roller bearing is configured to generate a spring force, wherein the lever portion of the handle includes a cam portion, the cam portion being configured to apply a first clamping force to the front clamping lever as the handle is moved from the unlocked position to the intermediate position and to apply a second clamping force to the front clamping lever as the handle is moved from the intermediate position to the locked position, wherein the first clamping force is less than the spring force, and wherein the second clamping force is greater than the spring force.

10. The table saw of claim 9, wherein the front portion of the frame is slidable in relation to the rear portion of the frame, wherein the rear clamping lever is fixedly attached to the rear portion of the frame, and wherein the linkage comprises the rear portion of the frame.

11. The table saw of claim 10, wherein the linkage comprises a rod that is coupled at one end to the handle and at another end to the rear clamping lever, wherein the rear clamping lever is pivotably attached to the rear end portion of the frame for pivotal movement between the clamped and unclamped positions, and wherein, when the front clamping lever is moved to clamped position by the lever portion of the handle, continued movement of the handle to locked position results in the handle pulling the rod and the rod in turn pivoting the rear clamping lever from the unclamped to the clamped position.

* * * * *